US011173503B2

(12) United States Patent
Mikse

(10) Patent No.: US 11,173,503 B2
(45) Date of Patent: Nov. 16, 2021

(54) DEVICE FOR DISPENSING AN ATOMIZED SPRAY

(71) Applicant: Michel Mikse, Poway, CA (US)

(72) Inventor: Michel Mikse, Poway, CA (US)

( * ) Notice: Subject to any disclaimer, the term of this patent is extended or adjusted under 35 U.S.C. 154(b) by 353 days.

(21) Appl. No.: 16/158,196

(22) Filed: Oct. 11, 2018

(65) Prior Publication Data

US 2019/0105668 A1 Apr. 11, 2019

Related U.S. Application Data

(60) Provisional application No. 62/570,898, filed on Oct. 11, 2017.

(51) Int. Cl.

| | |
|---|---|
| ***B05B 7/08*** | (2006.01) |
| ***B05B 7/24*** | (2006.01) |
| ***B05B 13/04*** | (2006.01) |
| ***B65D 83/20*** | (2006.01) |
| ***A45D 33/02*** | (2006.01) |
| ***B05B 3/02*** | (2006.01) |
| ***B05B 7/06*** | (2006.01) |
| ***B65D 83/26*** | (2006.01) |
| ***B65D 83/14*** | (2006.01) |

(Continued)

(52) U.S. Cl.

CPC ..... *B05B 1/205* (2013.01); *A45D 40/0075* (2013.01); *B05B 7/066* (2013.01); *B05B 7/0853* (2013.01); *B05B 7/2416* (2013.01); *B05B 13/0457* (2013.01); *B65D 83/207* (2013.01); *B65D 83/26* (2013.01); *B65D 83/262* (2013.01); *B65D 83/753* (2013.01); *A45D 33/02* (2013.01); *A45D 2200/057* (2013.01); *B05B 3/023* (2013.01)

(58) Field of Classification Search

CPC ..... A45D 40/0075; A45D 33/02; A45D 2200/057; B05B 1/3033; B05B 1/32; B05B 1/3066; B05B 1/205; B05B 7/2416; B05B 7/0853; B05B 7/066; B05B 13/0457; B05B 83/207; B05B 83/753; B05B 3/14; B05B 3/02; B05B 3/023; B05B 3/025; B05B 9/0855; B05B 9/0861; B65D 83/14; B65D 83/16; B65D 83/26; B65D 83/262

USPC ..... 222/62, 63, 333, 174, 394, 320–321.9, 222/383.1–385

See application file for complete search history.

(56) References Cited

U.S. PATENT DOCUMENTS 5,664,593 A 9/1997 McClain
6,443,164 B1 9/2002 Parker et al.

(Continued)

FOREIGN PATENT DOCUMENTS

IT WO2014001994 * 1/2014 ..... B05B 7/24

*Primary Examiner* — Alex M Valvis
*Assistant Examiner* — Christopher R Dandridge
(74) *Attorney, Agent, or Firm* — CP Law Group PC; Cy Bates

(57) ABSTRACT

The disclosure concerns a device for dispensing an atomized spray of a cosmetic composition. The device is capable of individual or commercial use, and provides yaw and pitch actuation of an operational head, along with the atomized spray to deliver the cosmetic composition to the body of a user. Electronics are configured to acquire data from a disposable spray bottle assembly, and approximate remaining volume or spray time according to the data. A linear laser provides guidance to the user for standing in order to receive optimal spray coverage.

13 Claims, 5 Drawing Sheets

(51) Int. Cl.
*B05B 1/20* (2006.01)
*A45D 40/00* (2006.01)

(56) References Cited

U.S. PATENT DOCUMENTS

| | | | | |
|---|---|---|---|---|
| 7,191,959 | B2 * | 3/2007 | Kutay | B05B 7/2416<br>239/10 |
| 2004/0078278 | A1 * | 4/2004 | Dauga | A61B 5/0059<br>434/100 |
| 2006/0032946 | A1 * | 2/2006 | Cooper | B05B 7/2405<br>239/532 |
| 2014/0291412 | A1 | 10/2014 | Henson | |
| 2016/0000273 | A1 | 1/2016 | Shah et al. | |

* cited by examiner

DEVICE FOR DISPENSING AN ATOMIZED SPRAY

CROSS-REFERENCE TO RELATED APPLICATIONS

This application claims benefit of priority with commonly owned U.S. Provisional Application Ser. No. 62/570,898, filed Oct. 11, 2017; the entire contents of which are hereby incorporated by reference.

BACKGROUND

Field of the Invention

The invention relates to systems and devices for delivering cosmetic compositions to a user; and more particularly, to a device for dispensing an atomized spray of such cosmetic compositions.

Description of the Related Art

Conventional devices and systems for dispensing cosmetic compositions, such as, for example, tanning compositions, sunblock compositions, skin moisturizing lotions, and other cosmetic compositions, are generally too large to operate in the home of an individual user and lack other modern technological features for improving the overall experience of one who utilizes such devices and systems.

There is a need for improved devices configured to dispense an atomized spray of various cosmetic compositions.

SUMMARY

In one embodiment, a device for dispensing an atomized spray of a cosmetic composition is disclosed. The device is capable of individual or commercial use, and provides yaw and pitch actuation of an operational head, along with the atomized spray to deliver the cosmetic composition to the body of a user. Electronics are configured to acquire data from a disposable spray bottle assembly, and to approximate remaining volume or spray-time according to the data. A linear laser provides guidance to the user for standing in order to receive optimal spray coverage.

In another embodiment, a spray bottle assembly for use with a dispensing device is disclosed. The spray bottle assembly generally comprises a bottle portion containing a cosmetic composition, a release mechanism and port thereof for releasing the cosmetic composition from the bottle portion, an insert for receiving and communicating each of the cosmetic composition and an amount of compressed air to a mixing chamber, wherein a nozzle-portion is coupled to the insert at a terminal end thereof, and the cosmetic composition is expelled from the nozzle-portion to form a compressed stream, and amount of compressed air is mixed with the compressed stream and atomized at a mixing chamber prior to expulsion through a spray aperture. The nozzle-portion, or nozzle-portion and insert combination, can be selected by a user to achieve desired spray pattern characteristics. A shell is generally provided which encapsulates and protects the nozzle-portion and insert.

Other embodiments are further described herein.

BRIEF DESCRIPTION OF THE DRAWINGS

These and other features and benefits will be appreciated by one with skill in the art upon a thorough review of the appended detailed descriptions and drawings, wherein.

DETAILED DESCRIPTION

Figure 1:
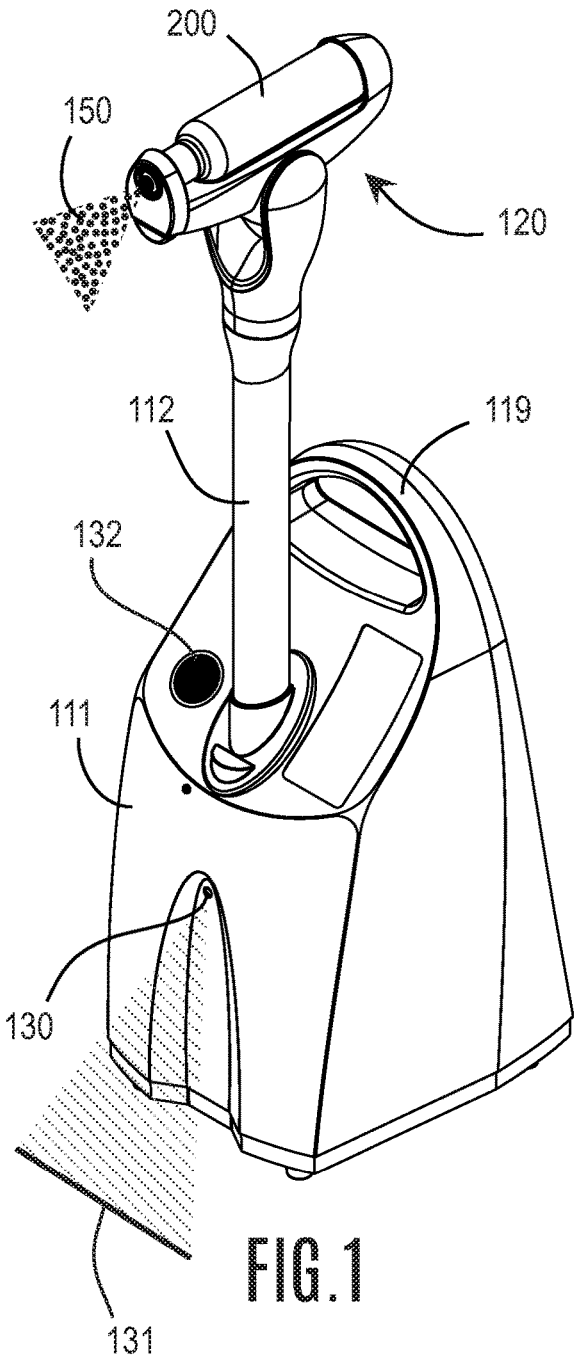
FIG. 1 shows a perspective view of a front-side of a device for dispensing an atomized spray of cosmetic compositions.

In the following description, for purposes of explanation and not limitation, details and descriptions are set forth in order to provide a thorough understanding of the embodiments of the invention. However, it will be apparent to those skilled in the art that the present invention may, be practiced in other embodiments, including certain variations or alternative combinations that depart from the explicit disclosure of the embodiments illustrated herein. The illustrated examples are intended to enable those with skill in the art to practice the invention, but such examples shall not reasonably be construed as limiting the spirit and scope of the invention as-claimed.

General Embodiments

In one embodiment, with reference to FIGS. 1-5, a device (100) for dispensing an atomized spray is disclosed and illustrated in accordance with a preferred embodiment. The device generally comprises: a device housing (111); a post (112) extending from the device housing to an operational head (120); a vertically-articulating arm (113), the vertically-articulating arm being coupled to the post at a horizontally-articulating joint (121); a plurality of stepper motors (114*a*; 114*b*), each of the stepper motors being individually adapted to rotate one of: the horizontally-articulating joint and the vertically-articulating arm; a compressed-air source (115); a compressed-air channel (116) extending from the compressed-air source to the operational head; a receptacle portion (117) disposed at the operational head and configured to receive a spray bottle assembly (200), wherein a bottle portion (201) of the spray bottle assembly is configured to contain at least one cosmetic composition (203) therein; characterized in that the device is configured to: actuate components of the operational head for engaging a release mechanism (202) of the spray bottle assembly, thereby communicating the cosmetic composition through an insert lumen (215) and a nozzle-portion (213), mix the cosmetic composition with compressed air from the compressed air source to form a cosmetic composition mixture, and deliver an atomized spray containing the cosmetic composition mixture through a spray aperture (275).

In the embodiment as-illustrated herein, the operational head includes a combination of the vertically-articulating arm and the horizontally-articulating joint.

While an illustrated embodiment shows a horizontally-articulating joint coupled to the post via a stepper motor therebetween, it is within contemplation of this disclosure to alternatively provide a stepper motor between the post and the housing such that the entire post is configured to rotate horizontally (i.e. left to right and vice versa about a vertical axis), in which embodiment the horizontally-articulating joint may not be required.

The compressed air source may comprise an internal air compressor, or a port for receiving compressed air from an external source.

While a distinct nozzle-portion is shown as being coupled to the insert in the illustrated embodiment, it is contemplated that the nozzle-portion may be integrated with the insert as a single monolithic piece, for example by molding the insert and drilling the nozzle-portion cavity therein. In yet another embodiment, the nozzle-portion, insert, and shell may be provided as a single monolithic piece as opposed to an assembly. With this in mind, it is preferred to provide the nozzle-portion, insert, and shell as separate and integrated assembly.

The nozzle-portion can be configured to deliver the atomized spray in accordance with a desired spray pattern.

The spray pattern may comprise spray pattern characteristics, such as: spray pattern, capacity, spray impact, spray angle, droplet size, or a combination thereof.

The plurality of stepper motors may comprise: at least one yaw-rotation motor (114*a*) and at least one pitch-rotation motor (114*b*). In this regard, the operational head can be configured for yaw- and pitch-articulation during dispensing of the atomized spray.

Each of the bottle portion and a spray nozzle assembly can be independently selected and combined to provide the cosmetic composition and spray pattern characteristics as desired by a user. For purposes herein, the "spray nozzle assembly" includes a combination of the insert and nozzle-portion. Moreover, as used herein the "spray bottle assembly" includes at least the spray nozzle assembly coupled to the bottle portion.

In a preferred embodiment, the spray bottle assembly further comprises a shell portion (220), the shell portion being configured to encapsulate and protect the nozzle-portion and insert of the spray nozzle assembly. Thus, in the preferred embodiment, the spray bottle assembly may comprise the insert, nozzle-portion, shell, and bottle portion.

The receptacle portion can be configured for button-actuated release to open the receptacle portion for changing the spray bottle assembly or components thereof.

The device housing can be configured for button-actuated release to translate at least a portion of the post into a volume of the device housing for collapsibility and improved storage.

The operational head may comprise a circuit, which may be referred to as a "second circuit" (distinct from the first circuit which is disposed within the device housing), wherein the second circuit is configured for one or more of powering at least one of the stepper motors, reading information from the spray bottle (RFID, barcode, etc.), and powering the triggering solenoid for engaging the release mechanism.

In some embodiments, the RFID tag of the spray bottle assembly can be write to store information related to remaining volume of cosmetic composition therein. For example, the device can determine an initial volume within the spray bottle assembly according to information from the RFID tag, and as the device is used it can calculate the volume of cosmetic composition used, then the device can rewrite or update the RFID with current volume data prior to releasing the spray bottle assembly. In this regard, a first bottle can be used and stored while a second bottle is used, then the first bottle may be re-inserted for continued use, each time the machine tracking data associated with the remaining volume within the spray bottle assembly.

In a preferred embodiment, the post is hermetically sealed with the compressed air channel for communicating compressed air to the operational head, without loss and without cosmetic composition ingress.

The insert preferably includes a compressed air chamber for communicating the compressed air from the compressed air channel of the device to the mixing chamber of the spray nozzle assembly.

The device can include a computerized control unit, the computerized control unit comprising at least one circuit containing a processor and memory, wherein the at least one circuit is configured to acquire and store spray bottle data. The computerized control unit can be configured to receive the spray bottle data from the spray bottle assembly. For example, the computerized control unit can be configured to receive the spray bottle data form a radio-frequency identification (RFID) tag of the spray bottle assembly. Alternatively, a barcode reader can be implemented at the receptacle portion and configured to scan a corresponding barcode affixed to the bottle portion of the spray bottle assembly. The spray bottle data can comprise one or more from the group consisting of: bottle indicia, cosmetic composition indicia (formulation, viscosity, etc.), volume indicia, date, and time. In some embodiments, the computerized control unit may comprise a first circuit housed within the device housing and configured as the primary circuit, and a second circuit disposed within the operational head and configured as a limited circuit for powering at least one of the stepper motors, reading information from the spray bottle (RFID, barcode, etc.), and powering the triggering solenoid for engaging the release mechanism of the spray bottle assembly.

In one embodiment, the device is configured to actuate the components of the device for providing an atomized spray of the cosmetic composition only if the bottle indicia meet authentication requirements. In other words, the device is configured to function only with an authentic spray bottle assembly for quality assurance.

In one embodiment, the computerized control unit is configured to: approximate a volume of the cosmetic composition contained within the spray bottle, a time of remaining spray according to the volume of the cosmetic composition, or a combination thereof, and communicate the volume, time, or combination thereof to a user.

The device may further comprise a laser source disposed at a front side of the device housing (relative to a user receiving the cosmetic composition), the laser source being configured to provide a linear laser light for indicating to a user a position for standing and receiving the atomized spray of the device.

In one embodiment, one or more of the plurality of stepper motors, the components of the operational head, or a combination thereof, are each disposed within the compressed air channel for cooling thereof by way of air-flow between the compressed air source and the cooled componentry.

Turning now to another aspect of the invention, a spray bottle assembly (200) for use with an atomized spray dispensing device (100) is disclosed. The spray bottle assembly comprises: a container (201) for holding at least one cosmetic composition within an interior volume thereof; a port (202) extending outwardly from the interior volume of the container and configured to communicate the at least one cosmetic composition therethrough; and a spray nozzle assembly (299) for dispensing an atomized spray comprising the at least one cosmetic composition, the spray nozzle assembly including: an insert (210) having a proximal end and a distal end, a nozzle-portion (213) coupled to the insert at the proximal end thereof, an insert-lumen (215) extending through the nozzle from the proximal end to the distal end thereof, the insert-lumen being configured to engage at least a portion of the port, and an optional outer shell (220) configured to surround each of the nozzle-portion, the insert, and the port for providing alignment and protection thereof.

In some embodiments, the nozzle-portion and the insert are integrated as a monolithic single piece. In other embodiments, the nozzle-portion is distinct from the nozzle and combined therewith to form at least part of the spray nozzle assembly.

The optional, but preferred, outer shell may further comprise one or more radially-disposed apertures.

The insert may further comprise one or more radially-disposed openings (214), the radially disposed openings being accessible through the radially-disposed apertures of the shell.

The port can be configured to be actuated via translation of the insert; i.e. the insert is configured to depress the port for releasing the cosmetic composition.

The spray bottle assembly may further comprise a radiofrequency identification (RFID) tag affixed thereto. Alternatively, a barcode or similar system may be implemented in a similar manner for purposes of identifying the cosmetic composition, volume, and other indicia such that the device may calculate remaining-time, remaining-volume, and other useful information associated with the use of the device.

The RFID tag or barcode may comprise spray bottle data. The spray bottle data may comprise one or more from the group consisting of: bottle indicia, cosmetic composition indicia (formulation, viscosity, etc.), volume indicia, date, and time. The spray bottle data may be updated or rewritten to the RFID tag of the spray bottle assembly after each use, or prior to releasing the spray bottle assembly from the operational head. The spray bottle data can be encrypted using conventional techniques in order to prevent counterfeiting.

These and other features and benefits are described in the following illustrated examples:

Example 1: Device for Dispensing an Atomized Spray

Figure 2:
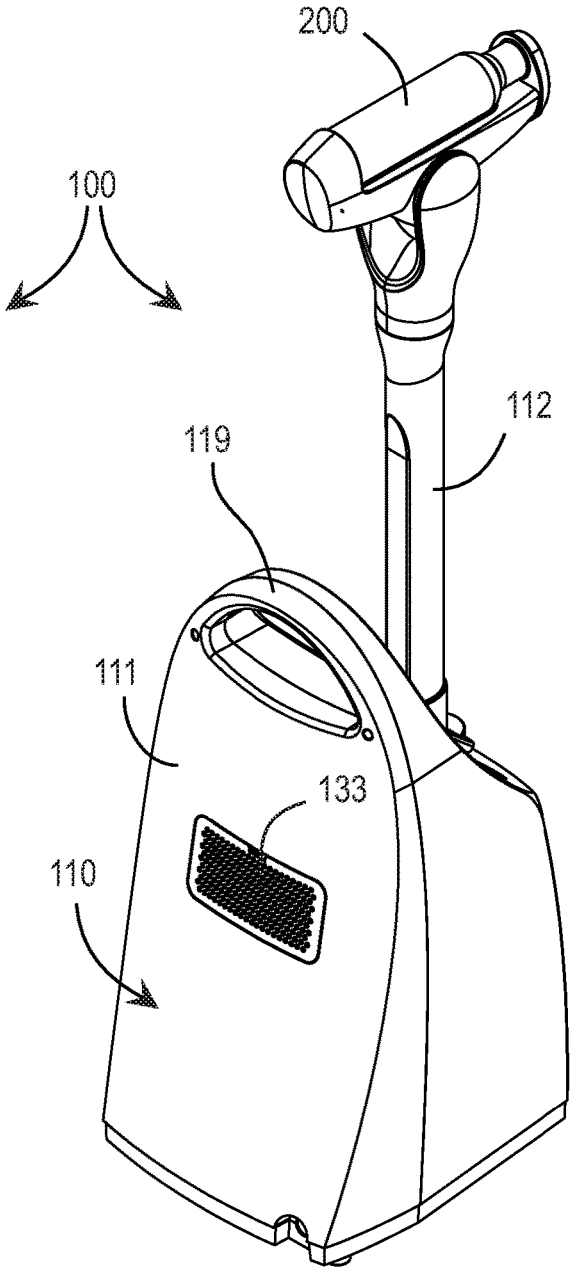
FIG. 2 shows a perspective view of a rear-side of the device.

Now turning to the drawings, FIGS. 1 and 2 show a device 100 for dispensing an atomized spray in accordance with an illustrated embodiment.

The device 100 generally includes a base 110, including a device housing 111 and a base handle 119. Extendable from the device housing is a post 112, and coupled thereto is an operational head 120. The operational head is configured with a receptacle portion for receiving a spray bottle assembly 200. When componentry of the operational head is actuated, a release mechanism of the spray bottle assembly is actuated for releasing an amount of cosmetic composition 203 (FIG. 7) from an inner volume of the spray bottle into an insert-lumen and the nozzle-portion of the spray bottle assembly. The cosmetic composition is mixed with an amount of compressed gas (air) in a mixing chamber, which is disposed between the nozzle-portion and a spray aperture, thereby forming an atomized spray 150. While an illustrated embodiment is described herein, those with skill in the art will appreciate a myriad of possible mechanical embodiments for generating an atomized spray, and such conventional embodiments appreciated by one having ordinary skill in the art are deemed to be incorporated by reference; as such, limited discussion is provided herein.

The entire spray bottle assembly may be discarded and replaced as needed or desired. The spray bottle assembly may comprise a tanning lotion, sunscreen composition, skin moisturizer, or other cosmetic composition, or a combination thereof. A consumer may purchase a replacement spray bottle assembly, which will include a brand-new spray nozzle assembly (nozzle-portion, insert, and optional shell) for inserting into the receptacle portion of the device. In this regard, the operational head needs significantly less maintenance and cleaning, since, the nozzle is integrated within a disposable portion of the device. Other conventional equipment, in contrast, may require significant disassembly and cleaning at routine intervals. This, the ability to quickly replace a disposable spray nozzle assembly is a significant improvement in the art.

The device 100 may further comprise interface componentry 132, such as, for example, a display, such as a liquid crystal display (LCD), a speaker, and/or other communication means as-appreciated by one with skill in the art. The interface componentry is configured to provide a user with ability to utilize and customize an experience using the device.

In addition, the device may preferably include a laser source 130 configured to project a linear laser light 131 for indicating to a user a position for standing in order to receive optimized spray coverage of the cosmetic composition dispensed from the device.

The device may further comprise one or more vents 133 for venting exhaust air form the unit.

Figure 3:
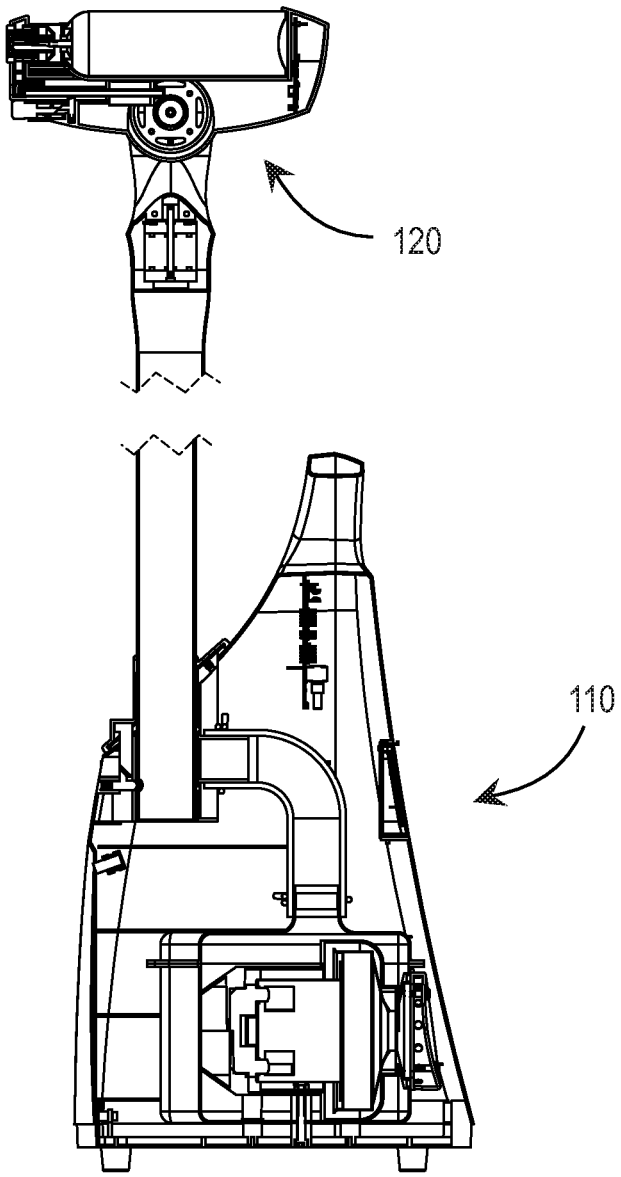
FIG. 3 shows a section view of the device including a base and an operational head.

FIG. 3 shows the device separated into its upper portion, herein termed the "operational head 120" and the lower portion "base 110".

Figure 4:
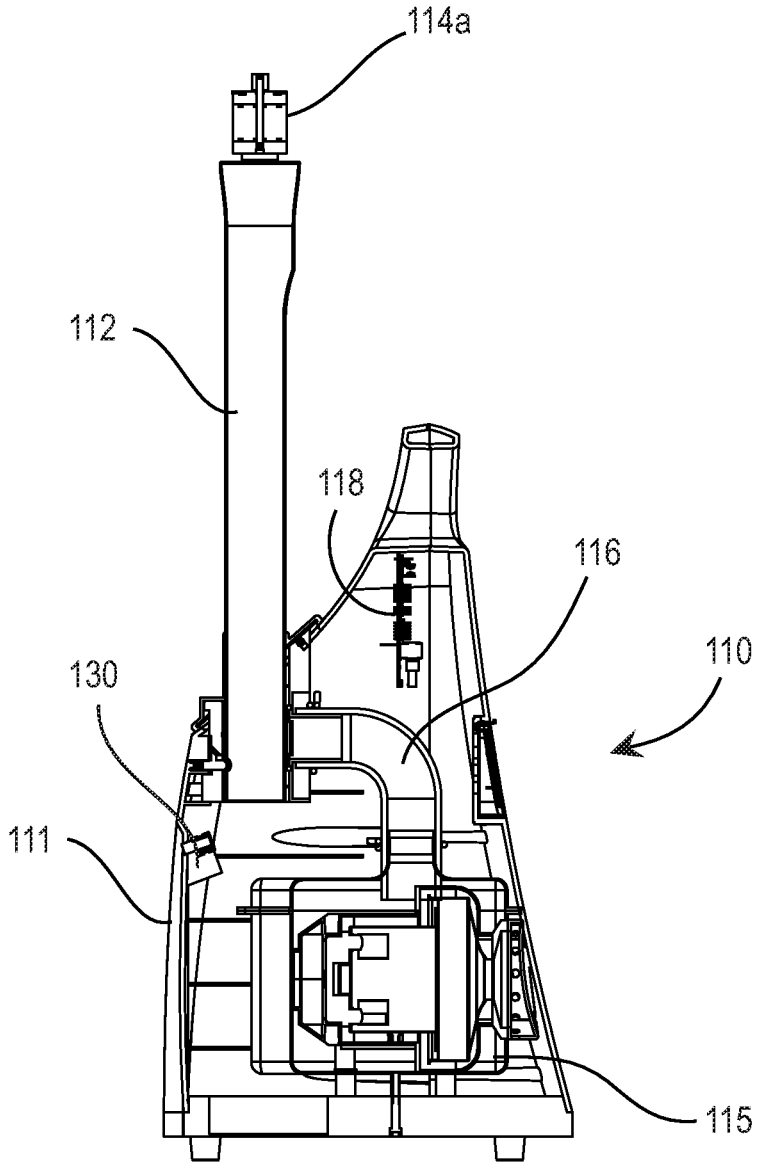
FIG. 4 shows another section view of the base of the device.

As shown in FIG. 4, the base 110 generally comprises a device housing 111 for protecting the internal componentry of the device, a compressed air source 115 (here an internal air compressor, though a port for receiving compressed air may be similarly employed), a compressed air channel 116 extending from the compressed air source 115 to the post 112. O-rings or other seals, along with techniques appreciated in the art, can be employed at an interface of the post and the compressed air channel for maintaining a hermetic seal therebetween. Compressed air is thereby configured for communication from the compressed air source, through the post, and into the operational head for generating the atomized spray.

At an upper end of the post is a stepper motor, also referred to herein as a "yaw-rotation motor 114*a*". The use of stepper motors provides precision control of the spray pattern as it is translated for application of the atomized spray about the body of a user. Stepper motors can be controlled via a computerized control unit 118. Here, the computerized control unit is housed within the device housing 111, however, it can be positioned elsewhere about the device or may include multiple sub-units independently disposed about the device.

Electronic componentry, such as stepper motors and the like can be positioned within the device, such as within the compressed air channel, for re-using the compressed air for purposes of cooling componentry.

The computerized control unit may be configured to identify a spray bottle assembly disposed in a bed (within the receptacle portion) of the operational head. This can be achieved by implementing an RFID tag, for example, on the bottom of the spray bottle. Upon identifying a newlyinstalled spray bottle assembly, the computerized control unit is adapted to identify spray bottle data, such as: bottle indicia, cosmetic composition indicia, volume indicia, date, and time. For example, by acquiring information relating to volume of the cosmetic composition within the bottle, the computerized control unit can be configured with a software algorithm to relate composition volume with spray time for the purpose of estimating remaining volume in the bottle. In other words, the device can be configured to read a starting volume of the spray bottle assembly upon installation, and track the use thereof to calculate remaining volume of the cosmetic composition within the bottle, or remaining spray time thereof given parameters of the device as pre-programmed in the software. The device may thereby communicate the remaining volume (or spray time) of the installed spray bottle assembly, and may further communicate to a user when it may be time to replace the spray bottle assembly. This can be achieved using the interface componentry 132 (FIG. 1).

Figure 5:
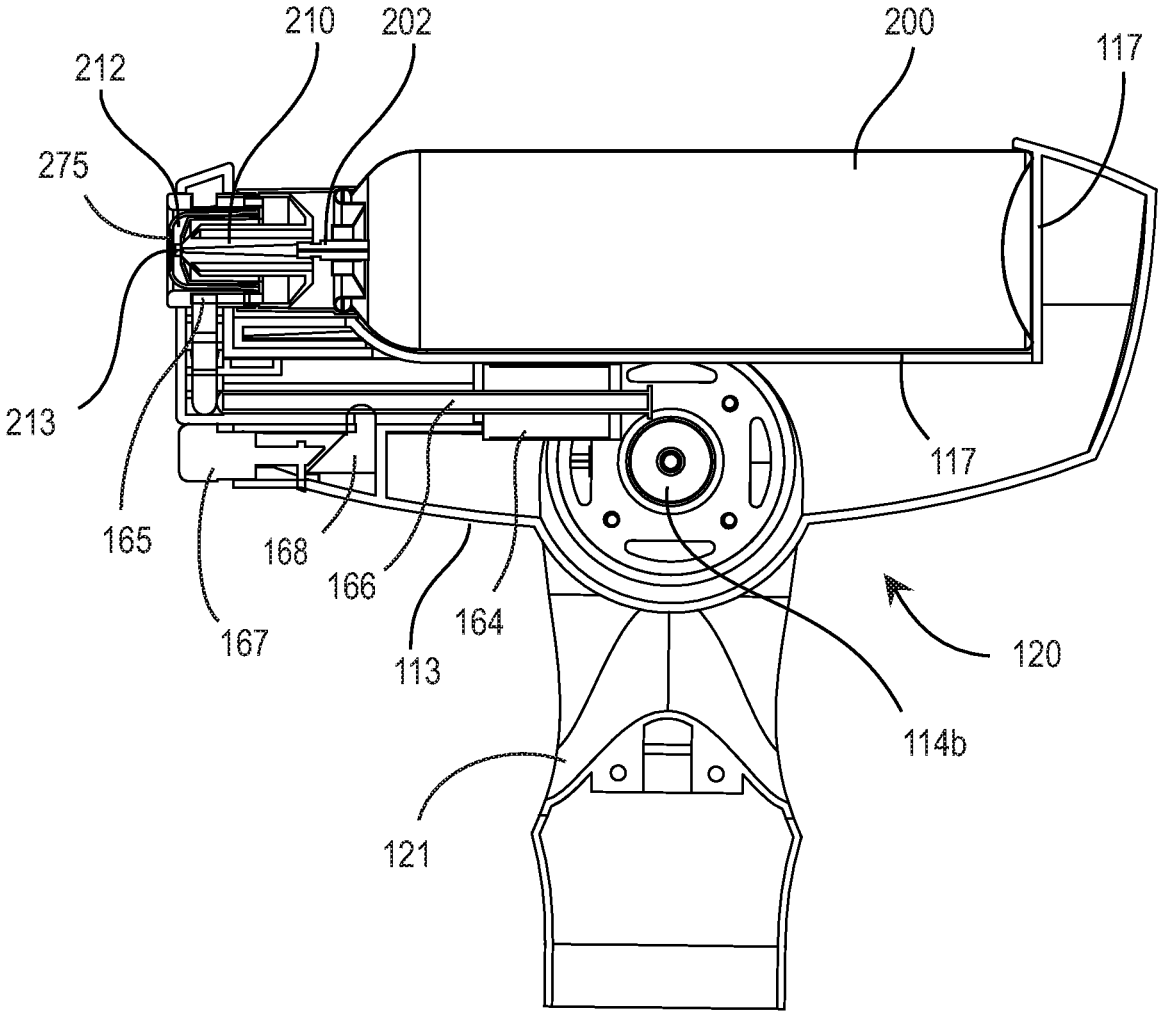
FIG. 5 shows another section view of the operational head of the device.

FIG. 5 shows the operational head 120 of the device 100 according to the illustrated embodiment.

Here, the device includes a second stepper motor referred to herein as a "pitch rotation motor 114*b*" which is used to couple the vertically-articulating arm 113 to the horizontally-articulating joint (121), and to actuate the vertically-articulating arm. The vertically-articulating arm is disposed adjacent to a receptacle portion 117 of the operational head 120. The receptacle portion is configured to receive and hold the spray bottle assembly 200.

Generally, the operation head includes a release element 165 configured to engage a combination of the insert 210 and the release mechanism 202 of the bottle assembly 200. The release element is preferably an internally-embedded feature that is not capable of accidental engagement of the release mechanism such that unwanted release of cosmetic composition is prevented. The release element generally applies force to the nozzle-portion, which in turn depresses the release mechanism of the spray bottle assembly. Other similar variations will be readily appreciated by one with skill in the art and may be implemented to accomplish the same or substantially similar result.

As shown in FIG. 5, the operational head 120 may comprise a triggering solenoid 164 configured to translate solenoid shaft 166 upon receiving electronic signals from the computerized control unit. Release element 165 is configured with a fulcrum for acting as a lever such that, when solenoid shall 166 engages a first end of the release element, a second end of the release element moves in an opposite direction, thereby applying translational force on the insert and causing the insert to depress the release mechanism 202 of the spray bottle assembly. Springs can be implemented to bias the home position of the solenoid shall, release element, or a combination thereof.

Also shown in FIG. 5 is the button-actuated release mechanism, wherein release button 167 is configured to drop release pin 168 upon pushing the release button 167, thereby releasing the bed such that a new spray bottle assembly may be installed.

When the release mechanism 202 is actuated, an amount of the cosmetic composition is expelled from the spray bottle and into an insert lumen 215, where the cosmetic composition is communicated through the insert lumen and the nozzle-portion 213 into a mixing chamber 212 for mixing with compressed air as it passes through the spray aperture 275. The result is atomized spray 150 (FIG. 1).

Different cosmetic compositions may comprise different viscosity and other physical properties. As such, a distinct nozzle-portion, insert and shell can be provided with each bottle. The combination of the spray bottle, nozzle-portion, insert and shell form the "spray bottle assembly", and the assembly is configured to be disposable. Similarly, the combination of the nozzle-portion, insert, and shell form a "spray nozzle assembly" as described herein.

Example 2: Spray Bottle Assembly for Use with a Dispensing Device

In another embodiment, a spray bottle assembly 200 for use with the device as-described above is disclosed with respect to an illustrated embodiment.

Figure 6:
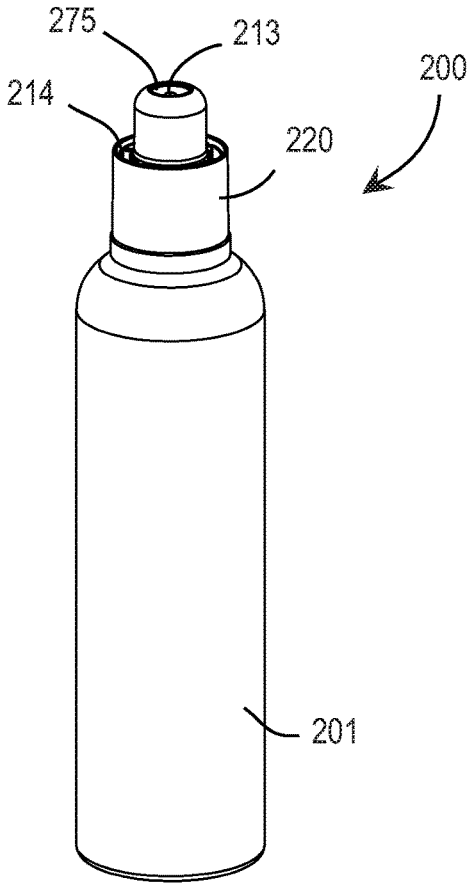
FIG. 6 shows a perspective view of a spray bottle assembly for use with the device.
Figure 8:
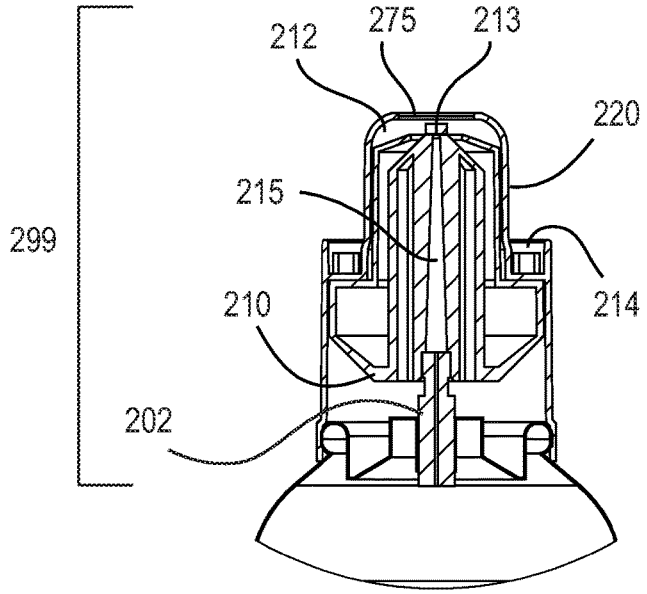
FIG. 8 shows another section view of the spray nozzle assembly.
Figure 7:
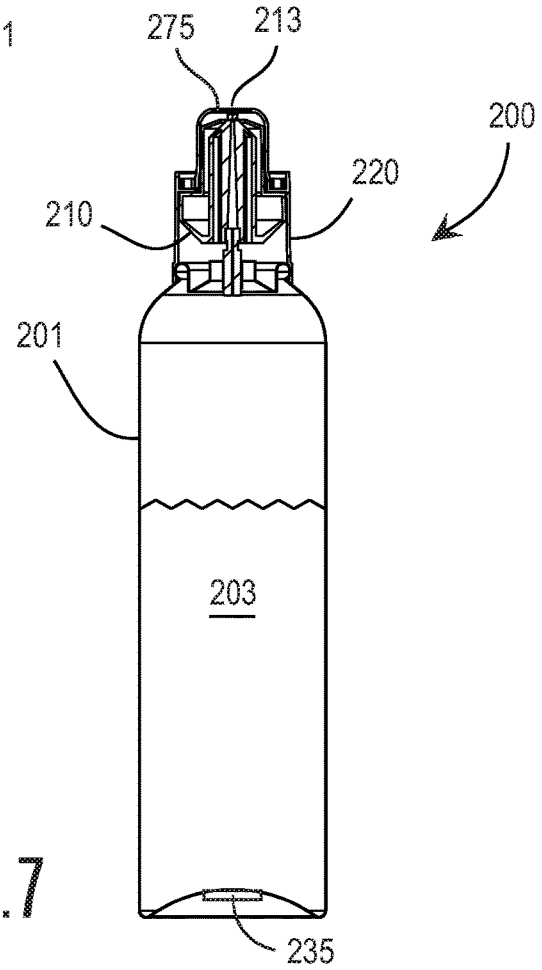
FIG. 7 shows a section view of the spray bottle including a bottle portion and a spray nozzle assembly.

With reference to FIGS. 6-8, a spray bottle assembly 200 is shown. The spray bottle assembly includes a spray bottle container 201, an insert 210 configured to engage a release mechanism 202 of the spray bottle container, a nozzle-portion 213 coupled to the insert at a terminal end thereof, a shell 220 configured to encapsulate and protect the nozzle-portion and insert, and a spray aperture 275 disposed at a proximal end of the spray bottle assembly.

The shell comprises one or more radially-disposed apertures for communicating compressed air from the operational head to the insert. The insert further comprises one or more radially-disposed openings 214 for receiving and communicating the compressed air received from the operational head. Silicone or polymer baffles can be implemented at the receptacle portion of the operational head and configured to engage the radially-disposed openings) of the insert such that a hermetic seal is maintained for receiving the compressed air. The compressed air is directed through a compressed air chamber of the insert, whereby it is expelled into a mixing chamber for mixing with the cosmetic composition in order to produce the atomized spray.

The spray bottle container 201 is shown containing cosmetic composition 203 in FIG. 7. A radiofrequency identification (RFID) tag 235 can be applied near a bottom surface of the bottle container, or otherwise attached to the spray bottle assembly in a manner sufficient for reading by the computerized control unit. The cross-section view of FIG. 7 further shows the nozzle-portion 213, insert 210, shell 220, and spray aperture 275 as-assembled for use.

Referring now to FIG. 8, the release mechanism 202 of the spray bottle is coupled to the insert lumen 215 of insert 210. Radially-disposed openings 214 extend through the shell 220 into the compressed air chamber of insert 210 for communicating compressed air from the operational head. The cosmetic composition is communicated form the spray bottle container, through a port of the release mechanism 202 and into the insert lumen 215, through the nozzle-portion 213, after which it is mixed with compressed air in mixing chamber 212 and expelled as atomized spray through spray aperture 275.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

What is claimed is:

1. A device (100) for dispensing an atomized spray, the device comprising:

a device housing (111);

a post (112) extending from the device housing to an operational head (120);

a vertically-articulating arm (113), the vertically-articulating arm being coupled to the post at a horizontally-articulating joint (121);

a plurality of stepper motors (114*a*; 114*b*) each being individually adapted to rotate one of:

the horizontally-articulating joint and the vertically-articulating arm;

a compressed-air source (115) comprising a compressed air;

a compressed-air channel (116) extending from the compressed-air source to the operational head;

a receptacle portion (117) disposed at the operational head and configured to receive a spray bottle assembly (200);

characterized in that the device is configured to:

actuate components of the operational head for engaging the spray bottle assembly, and deliver the atomized spray.

2. The device of claim 1, wherein the plurality of stepper motors comprises: at least one yaw-rotation motor (114*a*) and at least one pitch-rotation motor (114*b*).

3. The device of claim 1, wherein the receptacle portion is configured for a button-actuated release to open the receptacle portion for changing the spray bottle assembly or components of the spray bottle assembly.

4. The device of claim 1, wherein the device housing is configured for a button-actuated release to translate at least a portion of the post into a volume of the device housing for collapsibility.

5. The device of claim 1, wherein the post is hermetically sealed with the compressed air channel for communicating the compressed air to the operational head.

6. The device of claim 1, further comprising a computerized control unit, the computerized control unit comprising at least one circuit containing a processor and memory, wherein the circuit is configured to acquire and store spray bottle data.

7. The device of claim 6, wherein the computerized control unit is configured to receive the spray bottle data from the spray bottle assembly.

8. The device of claim 7, wherein the computerized control unit is configured to receive the spray bottle data form a radio-frequency identification (RFID) tag of the spray bottle assembly.

9. The device of claim 6, wherein the spray bottle data comprises one or more from the group consisting of: bottle indicia, cosmetic composition indicia, volume indicia, date, and time.

10. The device of claim 9, wherein the device is configured to actuate the components of the device for providing the atomized spray only if the bottle indicia meets authentication requirements.

11. The device of claim 6, wherein the computerized control unit is configured to:

approximate a volume of the cosmetic composition contained within the spray bottle, a time of remaining spray according to the volume of the cosmetic composition, or a combination thereof, and communicate the volume, time, or combination thereof to a user.

12. The device of claim 1, comprising a laser source disposed at a front side of the device housing, the laser source being configured to provide a linear laser light for indicating to a user a position for standing and receiving the atomized spray of the device.

13. The device of claim 1, wherein the plurality of stepper motors, the components of the operational head, or a combination thereof, are each disposed within the compressed air channel for cooling.

* * * * *